US009827589B2

(12) United States Patent
Daviot et al.

(10) Patent No.: US 9,827,589 B2
(45) Date of Patent: Nov. 28, 2017

(54) DISPENSING AND APPLICATION HEAD

(71) Applicant: APTAR FRANCE SAS, Le Neubourg (FR)

(72) Inventors: Stephane Daviot, Graveron Semerville (FR); Frederic Duquet, Crespieres (FR); Francis Moreau, Sotteville les Rouen (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/908,765

(22) PCT Filed: Jul. 29, 2014

(86) PCT No.: PCT/FR2014/051957
§ 371 (c)(1),
(2) Date: Jan. 29, 2016

(87) PCT Pub. No.: WO2015/015108
PCT Pub. Date: Feb. 5, 2015

(65) Prior Publication Data

US 2016/0184861 A1 Jun. 30, 2016

(30) Foreign Application Priority Data

Jul. 31, 2013 (FR) ..... 13 57610

(51) Int. Cl.
*A47L 13/30* (2006.01)
*B05C 17/10* (2006.01)
(Continued)

(52) U.S. Cl.
CPC ..... *B05C 17/10* (2013.01); *A45D 34/04* (2013.01); *B05B 11/0091* (2013.01);
(Continued)

(58) Field of Classification Search
CPC ..... A45D 34/04; A45D 34/041; A45D 2200/155; B65D 35/36; B05B 11/3047; B05C 17/10
(Continued)

(56) References Cited

U.S. PATENT DOCUMENTS 9,155,372 B2 * 10/2015 Gieux ..... A45D 34/04
9,277,798 B2 * 3/2016 Moreau ..... A45D 34/04
(Continued)

FOREIGN PATENT DOCUMENTS

EP 2062495 A1 5/2009
FR 2860768 A1 4/2005
(Continued)

OTHER PUBLICATIONS

International Search Report of PCT/FR2014/051957 dated Oct. 21, 2014.
(Continued)

*Primary Examiner* — Jennifer C Chiang
(74) *Attorney, Agent, or Firm* — Sughrue Mion, PLLC

(57) ABSTRACT

A dispenser and applicator head (T1) having a connection stub (1) made of a substantially-rigid first material; an assembly core (2) made of the same material; a flexible link section (S) that interconnects the connection stub and the assembly core; an applicator pad (5) made of a heat-transfer material to impart a cold sensation on contact with the skin and mounted on the assembly core; and a dispenser channel (6) that passes through the stub, the link section, the core, and the pad in which it forms a dispenser orifice. The link section includes a flexible bridge (3) made of the same material as the stub and interconnecting the stub and the core; and sheathing (4) made of an elastically-deformable material, the sheathing surrounding the bridge, at least in part, and interconnecting the stub and the core.

19 Claims, 4 Drawing Sheets

Figures 1, 2A, 2B, 3A, 3B, 4A, 4B:
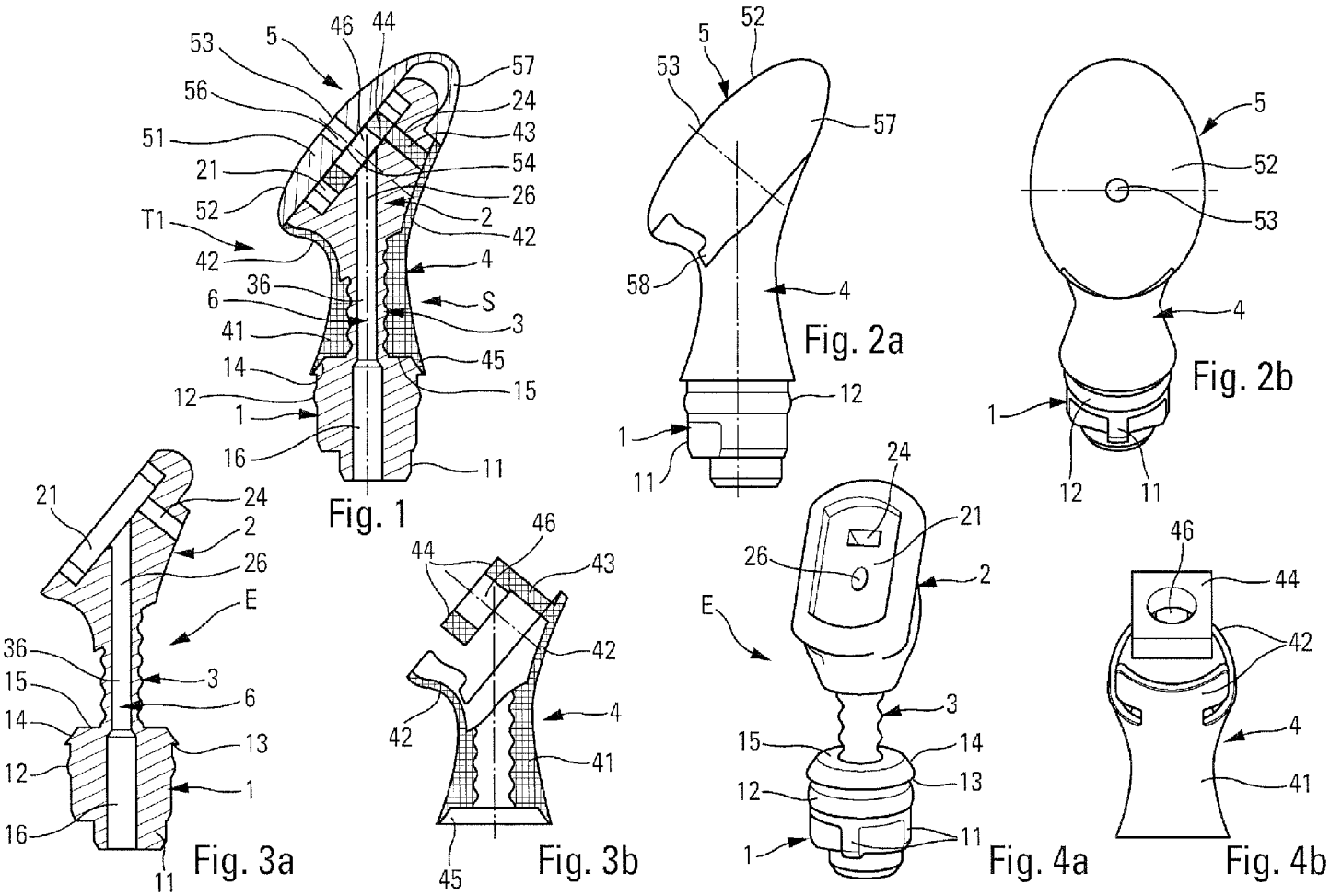

(51) Int. Cl.

| | |
|---|---|
| ***A45D 34/04*** | (2006.01) |
| ***B65D 35/36*** | (2006.01) |
| *B05B 11/00* | (2006.01) |
| *B65D 83/28* | (2006.01) |
| *B65D 83/30* | (2006.01) |

(52) U.S. Cl.
CPC ..... *B05B 11/3047* (2013.01); *B65D 35/36* (2013.01); *A45D 2200/056* (2013.01); *B05B 11/0048* (2013.01); *B05B 11/3032* (2013.01); *B65D 83/285* (2013.01); *B65D 83/30* (2013.01)

(58) Field of Classification Search
USPC ..... 401/261, 264, 265
See application file for complete search history.

(56) References Cited

U.S. PATENT DOCUMENTS

| | | | | |
|---|---|---|---|---|
| 9,456,678 | B1 * | 10/2016 | Harooni ..... | A45D 34/041 |
| 2007/0075097 | A1 | 4/2007 | Behar et al. | |
| 2016/0249726 | A1 * | 9/2016 | Jung ..... | A45D 34/04 401/261 |

FOREIGN PATENT DOCUMENTS

| | | | |
|---|---|---|---|
| WO | 2013/017801 | A1 | 2/2013 |
| WO | 2013/156730 | A1 | 10/2013 |

OTHER PUBLICATIONS

International Preliminary Report on Patentability dated Feb. 11, 2016, issued by the International Bureau in corresponding International Application No. PCT/FR2014/051957.

* cited by examiner

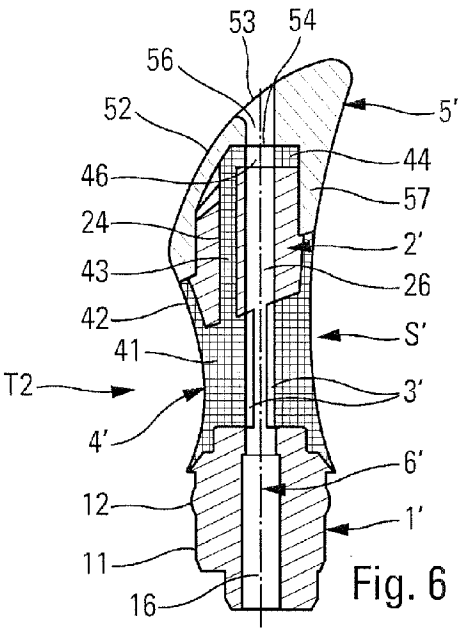
Fig. 6
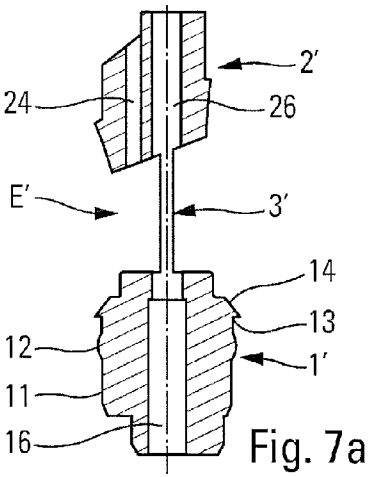
Fig. 7a
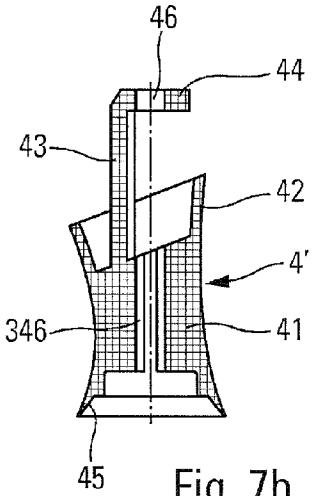
Fig. 7b
Fig. 8a
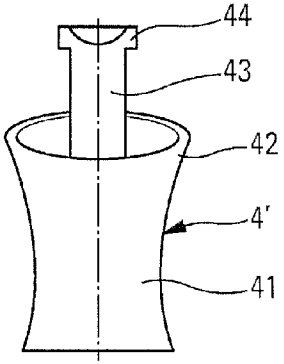
Fig. 8b
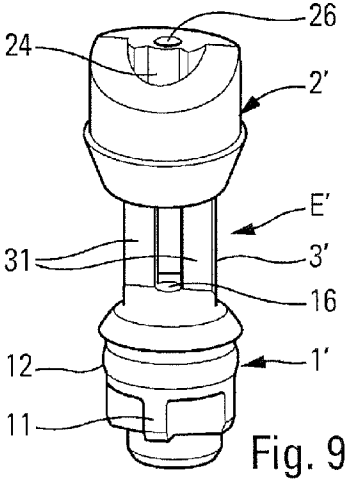
Fig. 9a
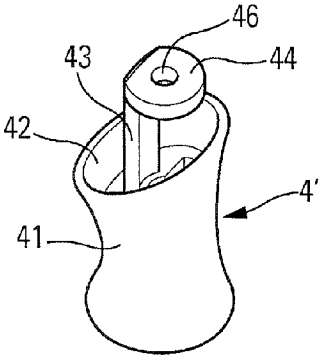
Fig. 9b

DISPENSING AND APPLICATION HEAD

CROSS REFERENCE TO RELATED APPLICATIONS

This application is a National Stage of International Application No. PCT/FR2014/051957 filed Jul. 29, 2014, claiming priority based on French Patent Application No. 1357610 filed Jul. 31, 2013, the contents of all of which are incorporated herein by reference.

The present invention relates to a dispenser and applicator head for associating with a dispenser unit, such as a pump, a valve, a squeezable tube, etc. The head comprises: a connection stub that is made out of a substantially-rigid first material and that is for connecting to the dispenser unit; an assembly core that is made out of the same material as the connection stub; and a flexible link section that interconnects the connection stub and the assembly core. The head further comprises a fluid applicator pad for coming into contact with an application surface, such as the skin, so as to apply fluid to the application surface, the applicator pad being made out of a heat-transfer material, such as metal or ceramic, so as to impart a cold sensation on contact with the skin, the applicator pad being mounted on the assembly core. The head defines a dispenser channel that passes through the connection stub, the flexible link section, the assembly core, and the applicator pad in which it forms a dispenser orifice. The present invention also defines a fluid dispenser including such a dispenser and applicator head. Advantageous fields of application of the present invention are the fields of cosmetics, perfumery, and pharmacy.

In the prior art, document WO 2013/017801 is already known that describes a dispenser and applicator head comprising an applicator pad made of metal or of ceramic that is connected to a connection section via a link section made out of an elastically-deformable material so that the applicator pad is movable relative to the connection section. A dispenser channel passes through the connection section and the link section, and then through the applicator pad in which it forms a dispenser orifice. The dispenser and applicator head is for associating with a pump or a squeezable tube, thereby constituting a dispenser. When the user takes hold of the dispenser via its reservoir and applies the pad to an application surface such as the skin, the link section may deform in such a manner that the applicator pad does not faithfully follow the movement made by the user. A certain amount of flexibility results where the applicator pad comes into contact with the skin, thereby imparting a massage effect.

In document WO 2013/017801, the dispenser and applicator head also forms an applicator section that is connected to the link section and that incorporates the applicator pad. In other words, the dispenser and applicator head of that document comprises an applicator pad that is mounted on a single-piece part made of plastics material that forms the connection section, the link section, and a portion of the applicator section that supports the applicator pad. The link section integrally forms a portion of the dispenser channel, which portion connects the connection section to the dispenser orifice.

However, that dispenser and applicator head presents a notable disadvantage, namely that the connection section for mounting in stationary and leaktight manner on a pump or on a squeezable tube, and also the applicator section in which the applicator pad is mounted, are both made out of the same material and integrally with the link section that forms a portion of the dispenser channel. As a result, it is essential to select a plastics material that is relatively flexible in order to impart flexibility to the link section, which implies that the connection and applicator sections also present a certain amount of flexibility. Unfortunately, such flexibility is particularly disadvantageous, since the connection and applicator sections are mounting pieces that need to present a certain amount of stiffness in order to guarantee the fastening and sealing functions. Consequently, making the connection, link, and applicator sections integrally requires a compromise between the flexibility of the link section and the stiffness of the connection and applicator sections. When the link section is particularly flexible, the connection and applicator sections do not have the necessary stiffness, and conversely, when the connection and applicator sections are stiff, the link section presents less flexibility.

An object of the present invention is to remedy the above-mentioned drawback of the prior art by defining a dispenser and applicator head having connection sections that present sufficient stiffness, while guaranteeing flexibility at the link section. Another object of the present invention is to make the plastics part as a single piece as in the prior art document WO 2013/017801, for the purpose of making molding and assembly easier.

To do this the present invention proposes a dispenser and applicator head for associating with a dispenser unit, such as a pump, a valve, or a squeezable tube, the head comprising:

- a connection stub that is made out of a substantially-rigid first material and that is for connecting to the dispenser unit;
- an assembly core that is made out of the same material as the connection stub;
- a flexible link section that interconnects the connection stub and the assembly core;
- a fluid applicator pad for coming into contact with an application surface, such as the skin, so as to apply fluid to the application surface, the applicator pad being made out of a heat-transfer material, such as metal or ceramic, so as to impart a cold sensation on contact with the skin, the applicator pad being mounted on the assembly core; and
- a dispenser channel that passes through the connection stub, the flexible link section, the assembly core, and the applicator pad in which it forms a dispenser orifice;

the dispenser and applicator head being characterized in that the flexible link section comprises:

- a flexible bridge that is made out of the same material as the connection stub and the assembly core, the flexible bridge interconnecting the connection stub and the assembly core in such a manner as to form a single-piece base; and
- sheathing that is made out of an elastically-deformable second material that is more flexible than the substantially-rigid first material, the sheathing surrounding the flexible bridge, at least in part, and interconnecting the connection stub and the assembly core.

Thus, the flexibility of the link section is no longer dependent on the stiffness of the connection stub and of the assembly core, which are nevertheless connected together integrally via the flexible bridge. It is thus possible to make the link section flexible with a particularly flexible bridge and sheathing that imparts a certain amount of resilience or ability to withstand deformation. The synergetic combination of the flexible bridge and the sheathing for forming the flexible section makes it possible to obtain various deformation characteristics for the flexible link section, while guaranteeing the necessary stiffness for the connection stub and the assembly core. In a particularly advantageous embodiment, the sheathing may be overmolded on the single-piece base around the flexible bridge.

In order to impart the necessary flexibility to the flexible bridge, it may present a wall thickness that is small compared to the connection stub and the assembly core.

According to a characteristic of the invention, the dispenser channel, at the link section, may be formed by the flexible bridge only. In this configuration, the flexible bridge may be in the form of a single straw that would be easily deformed, kinked, or damaged in the absence of the sheathing.

In another embodiment of the invention, the dispenser channel, at the link section, may be formed both by the flexible bridge and by the sheathing.

In still another embodiment of the invention, the dispenser channel, at the link section, may be formed by the sheathing only. The flexible bridge may thus be in the form of one or more fine rods that interconnect the connection stub and the assembly core without extending in the dispenser channel, which is made entirely by the sheathing.

In a practical embodiment, the applicator pad has a segment of dispenser channel passing therethrough and defining an upstream inlet and a downstream end that is formed by the dispenser orifice, the sheathing including a sealing extension that forms an O-ring gasket that is wedged between the assembly core and the applicator pad, around the upstream inlet, so as to form a sealed connection between the rigid assembly core and the applicator pad at the dispenser channel. It can thus be said that the flexibility of the sheathing is used to form the O-ring gasket that is flattened between the rigid assembly core and the rigid applicator pad.

According to another advantageous characteristic of the invention, the sheathing may include trim that extends around the assembly core as far as the applicator pad, so as to mask the assembly core, at least in part. The assembly core may thus be surrounded entirely, in such a manner that it is not visible to the user.

In another advantageous aspect of the invention, the flexible bridge may present deformability that is substantially unidirectional, the flexible bridge advantageously comprising at least one flat blade that is foldable in a single plane.

In another advantageous aspect of the invention, the dispenser head defines a main axis X that extends at least through the connection stub, the applicator pad being mechanically fitted and mounted on the assembly core along a mounting axis Z that extends transversally relative to the main axis X. It should be observed that secure mounting of the pad on the assembly core is possible as a result of the assembly core being made out of a rigid plastics material. In an advantageous embodiment, the assembly core may include two mounting slideways, and the applicator pad may include two slide rails that are received in the two mounting slideways along the mounting axis Z that is advantageously perpendicular to the dispensing axis Y of the dispenser orifice. The mounting axis Z that is transverse to the main axis X and that is also advantageously perpendicular to the dispensing axis Y, guarantees that the pad cannot be pulled off the assembly core when the dispenser head is removed from its dispenser unit, or when the fluid is applied to the skin. It should be observed that the characteristics associated with the transverse orientation of the mounting axis Z relative to the main axis X, and to its perpendicular orientation relative to the dispensing axis Y, may be protected separately from the characteristics associated with the flexible link section.

The invention also defines a fluid dispenser comprising a fluid dispenser unit and a dispenser and applicator head as defined above, wherein the dispenser unit comprises a pump or a squeezable tube including an opening on which the connection stub is mounted.

The spirit of the invention is to make a dispenser and applicator head that is comparable to the dispenser and applicator head of document WO 2013/017801, but having stiffness of the connection stub and of the assembly core that is totally uncorrelated with or independent of the flexibility of the flexible link section. Molding the connection stub and the assembly core as a single piece by means of a flexible bridge avoids several assembly operations and makes it possible to overmold the sheath of the sheathing.

The invention is described more fully below with reference to the accompanying drawings that show two embodiments of the invention by way of non-limiting example.

Figure 5B:
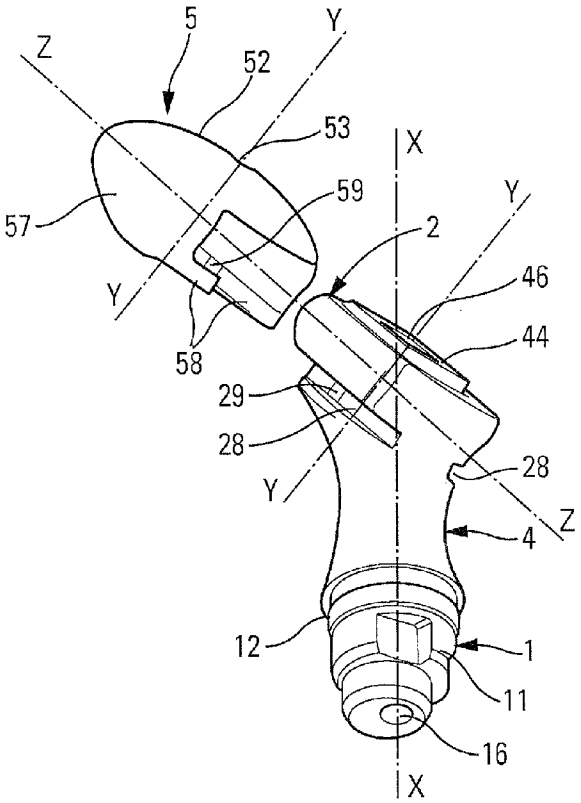
Figure 5A:
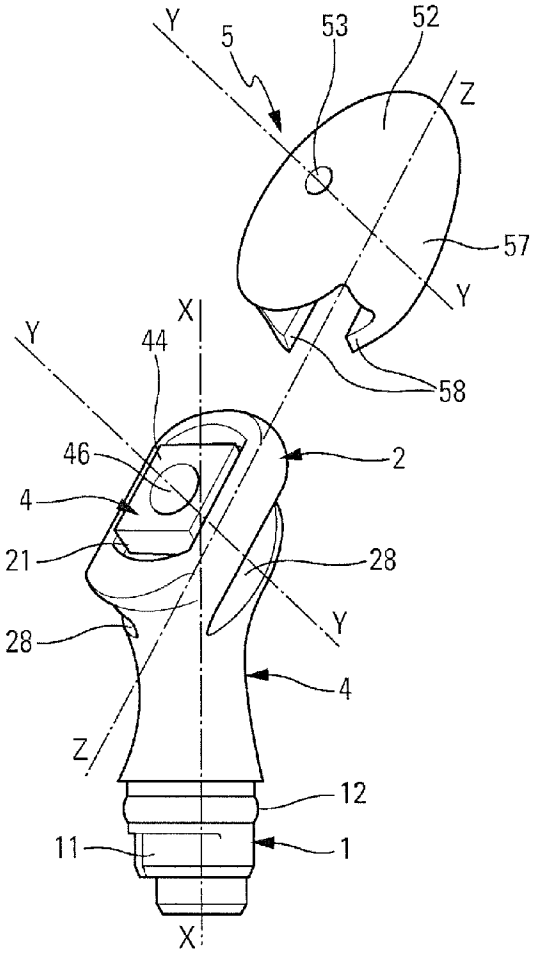
Figure 10B:
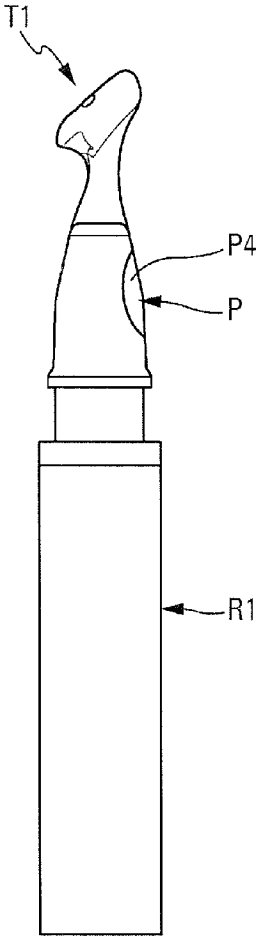
Figure 10A:
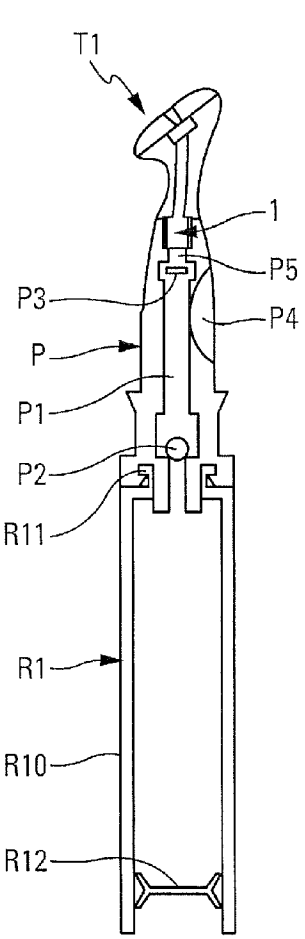

In the figures:

FIG. 1 is a vertical section view of a dispenser and applicator head in a first embodiment of the invention;

FIGS. 2*a* and 2*b* are views of the FIG. 1 head as seen respectively from the side and from a little above;

FIG. 3*a* is a vertical section view of the single-piece base of the FIG. 1 head;

FIG. 3*b* is a vertical section view of the sheathing of the FIG. 1 head;

FIGS. 4*a* and 4*b* are perspective views of the FIG. 3*a* single-piece base and of the FIG. 3*b* sheathing respectively;

FIGS. 5*a* and 5*b* are perspective views showing the operation of mounting the applicator head on the assembly core;

FIG. 6 is a vertical section view of a dispenser and applicator head in a second embodiment of the invention;

FIG. 7*a* is a vertical section view of the single-piece base of the FIG. 6 head;

FIG. 7*b* is a vertical section view of the sheathing of the FIG. 6 head;

FIG. 8*a* is side view of the FIG. 7*a* single-piece base;

FIG. 8*b* is a side view of the FIG. 7*b* sheathing;

FIGS. 9*a* and 9*b* are perspective views of the FIG. 8*a* single-piece base and of the FIG. 8*b* sheathing respectively;

FIG. 10*a* is a vertical section view of a pump dispenser incorporating the dispenser and applicator head in the first embodiment;

FIG. 10*b* is a side view of the FIG. 10*a* dispenser; and

Figure 11B:
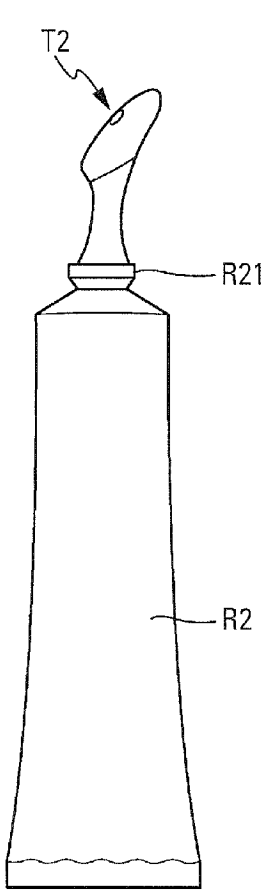
Figure 11A:
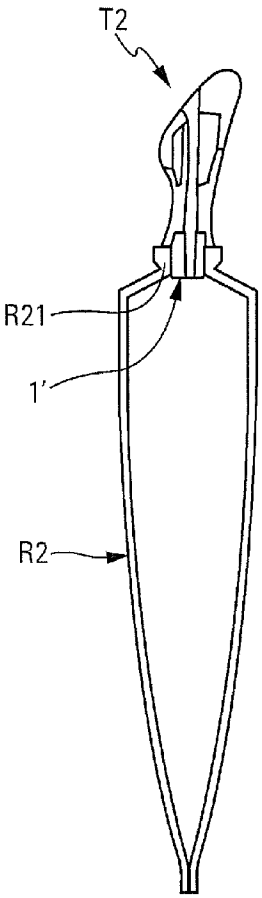

FIGS. 11*a* and 11*b* are views, similar to the views in FIGS. 10*a* and 10*b*, of a dispenser including a squeezable tube.

Reference is made firstly to FIGS. 1 to 5*b* in order to describe in detail the structure, the manufacture, and the assembly of a dispenser and applicator head T1 in the first embodiment of the invention. The head T1 comprises three single-piece elements, namely a single-piece base E, sheathing 4, and an applicator pad 5. The single-piece base E and the sheathing 4 are made out of appropriate plastics material, as described below. The applicator pad 5 is made of metal or ceramic, and more generally out of any heat-transfer material so as to impart a cold sensation on contact with the skin.

The sheathing 4 extends around the single-piece base E, at least in part, so that they co-operate with each other to constitute a unitary single endpiece on which the applicator pad 5 is mounted. Advantageously, the sheathing 4 is overmolded on the single-piece base E. The plastics materials that constitute the base E and the sheathing 4 are advantageously compatible, such that they are held by chemical bonding. The base E and the sheathing 4 co-operate with each other to form a flexible link section S that is situated in the middle portion of the unitary endpiece, as can be seen clearly in FIG. 1.

With reference to FIGS. 3*a* and 4*a*, it can be seen that the single-piece base E comprises a connection stub 1 in its bottom portion, an assembly head 2 in its top portion, and a bridge of material 3 in its intermediate portion that interconnects the connection stub 1 and the assembly head 2. It should be observed that the base E is made as a single piece, the stub 1, the core 2, and the bridge 3 being made out of a first material that is substantially rigid. Given that the bridge 3 presents a wall thickness that is much thinner than the wall thickness of the stub and of the core 2, the bridge 3 presents flexibility or deformability, such that the core 2 may be moved relative to the stub 1 by deforming the flexible bridge 3. In other words, the stub 1 and the core 2 that are completely rigid are interconnected by the bridge of material 3 that is flexible.

The single-piece base E has a dispenser channel 6 passing therethrough, from bottom to top, along a main axis X, which dispenser channel extends through the connection stub 1, the flexible bridge 3, and the assembly core 2 in which it opens out into a sloping dish 21. It should also be observed that a borehole 24 passes through the assembly core 2 so as to open out also into the sloping dish 21. At the flexible bridge 3, the dispenser channel 6 forms a segment 36 that is formed entirely by the flexible bridge 3. In other words, the flexible bridge 3 forms a tube interconnecting the stub 1 and the core 2, and having an inside that forms the segment 36 of the dispenser channel 6. The segment 36 is connected upstream to a segment 16 that is formed inside the stub 1, and downstream to another segment 26 that is formed inside the core 2 and that opens out into the sloping dish 21. It can be seen that the tube formed by the flexible bridge 3 presents wall thickness that is much thinner than the wall thicknesses of the stub 1 and of the core 2. To increase the flexibility of the flexible bridge 3 even more, it should be observed that the outer wall of the tube is corrugated, thereby reducing the wall thickness even more at the troughs. The core 2 may thus be moved relative to the stub 1 by deforming the flexible bridge 3 in elastic manner.

The inside of the connection stub 1 forms the segment 16, and its outside presents a profile that is complex, in particular comprising projecting side reinforcements 11, a snap-fastener and sealing bead 12, a downwardly-directed annular shoulder 13, a frustoconical shoulder 14, and an annular flat 15 from which there extends the flexible bridge 3 in the shape of a corrugated tube.

Reference is made below more particularly to FIGS. 3*b* and 4*b* in order to describe the sheathing 4 in detail. The sheathing is made out of an elastically-deformable plastics material that is more flexible than the substantially-rigid material of the single-piece base E. By way of example, the single-piece base E may be made out of a rigid thermoplastic such as polypropylene, polyethylene, or polyamide, for example, and the sheathing 4 may be made out of thermoplastic elastomer. The sheathing 4 comprises a main body 41 of shape that is very generally cylindrical, since it defines a hollow inside. At its bottom end, the main body 41 forms an outwardly- and downwardly-directed collar 45. At its top end, the main body 41 is extended so as to form trim 42 of wall thickness that is small. Advantageously, the trim 42 is provided with a sealing extension 43 that forms an O-ring gasket 44 that is arranged in sloping manner, as with the sloping dish 21. The inside of the O-ring gasket 44 forms a segment 46 of the dispenser channel 6, as described below. In FIG. 4*b*, it can be seen that the O-ring gasket 44 presents a configuration that is a rectangular parallelepiped.

As mentioned above, the sheathing 4 is mounted around the single-piece base, preferably by an overmolding technique. The result is shown in FIGS. 1, 2*a*, and 2*b*. The main body 41 of the sheathing 4 extends around the flexible bridge 3 of corrugated tube shape. It can be seen that the hollow inside of the main body 41 comes into intimate contact around the corrugated outline of the flexible bridge 3. At its bottom end, its collar 45 comes into contact with the frustoconical shoulder 14 as far as the shoulder 13. Intimate contact is also established at the annular flat 15. The trim 42 extends intimately around the assembly core 2 in such a manner as to come into contact with the applicator pad 5. Thus, the assembly core 2 may be masked or covered entirely with the trim 42 of the sheathing 4. The sealing extension 43 extends through the borehole 24, and its O-ring sealing gasket 44 is arranged inside the sloping dish 21, with the segment 46 arranged downstream of the segment 26 of the core 2. It should thus be observed that the O-ring gasket 44 also comes into contact with an inside face of the applicator pad 5, thereby constituting sealing between the core 2 and the pad 5.

In this first embodiment, the applicator pad 5 comprises a solid body 51 that has a segment 56 of the dispenser channel 6 passing therethrough, defining an upstream inlet 54 and a downstream end forming a dispenser orifice 53. The inside face of the solid body 51 comes into leaktight contact with the O-ring gasket 44. The outside face of the solid body 52 forms an application surface 52 that is convex a little. It should be observed that the solid body 51 is oriented in sloping manner relative to the dispenser channel at its segments 16, 26, and 36. It should also be observed that the segments 46 and 56 of the dispenser channel 6 are arranged in sloping manner relative to the other segments 16, 26, and 36. The applicator pad 5 also comprises a skirt 57 that extends around the solid body 51 on three of its sides. In FIGS. 5*a* and 5*b*, it should be observed that the peripheral skirt 57 forms two slide rails 58 for co-operating with two mounting slideways 28 formed at the core 2. Thus, the pad 5 may be fitted on the core 2 by a sliding movement along a mounting axis Z that is oriented in transverse manner relative to the main axis X of the head T1, that contains the segments 16, 26, and 36 of the dispenser channel 2. It should also be observed that the mounting axis Z of the pad 5 is perpendicular to the dispensing axis Y containing the segments 46 and 56 of the dispenser channel 2. In FIGS. 5*a* and 5*b*, it can easily be understood how the pad 5 may be fitted around the core 2 by engaging the two rails 58 of the skirt 57 in the two mounting slideways 28 arranged below the dish 21. One or more snap-fastener beads 29 may be provided at the slideways 28, for co-operating with snap-fastener housings 59 formed at the slide rails 58. In its final mounted position, the inside face of the solid body 51 comes into contact with the O-ring gasket 44 in such a manner as to compress it a little so as to achieve sealing. The skirt 57 comes into contact with the trim 42 of the sheathing 4, as can be seen in FIG. 1.

As a result of the transverse orientation of the mounting axis Z relative to the main axis X, it is not possible to remove the pad 5 accidentally from the assembly core 2 by pulling on the head T1 along its main axis X, as occurs in particular when it is desired to remove the connection stub 1 from a housing formed by a dispenser unit. Furthermore, with its orientation being perpendicular to the dispenser orifice, the pad does not risk being disconnected accidentally from the assembly core 2 while applying fluid to the skin. It should be observed that such a pad 5 with a mounting axis that is transverse, or indeed perpendicular, may be used on any dispenser head that presents an appropriate assembly core. In other words, the head does not need to incorporate a section the flexible connection comprising a flexible bridge associated with sheathing.

In this first embodiment of the invention, the sheathing 4 reinforces, in resilient manner, the tube-shaped flexible bridge 3 that would otherwise be very fragile and subject to kinking or breaking. In addition, the sheathing 4 also creates a flexible connection between the core 2 and the stub 1, and improves the overall appearance of the endpiece by masking the core 2 completely. When the head T1 is mounted on a dispenser unit, the connection stub 1 is no longer visible, such that the outside of the head T1 is defined only by the sheathing 4 and the applicator pad 5.

Reference is made below to FIGS. 6 to 9*b* in order to describe the second embodiment of a dispenser and applicator head T2 of the invention. The main component elements are the same as in the first embodiment and are designated by the same numerical references, however these references also include primes. Thus, the single-piece base E' comprises a connection stub 1', an assembly core 2', and a flexible bridge 3'. The mounting stub 1' may be strictly identical to that of the first embodiment, i.e. forming a segment 16 of the dispenser channel 6', side reinforcements 11, a snap-fastener and sealing bead 12, a shoulder 13, a frustoconical section 14, and an annular flat 15. The assembly core 2' also forms a segment 26 of the dispenser channel 6', and a borehole 24 through which the sealing extension 43 of the sheathing 4' passes. However, the flexible bridge 3' is different from the flexible bridge of the first embodiment, given that it is constituted by two flat blades 31 that each connect the stub 1' to the core 2'. The gap between the two flat blades 31 serves to pass the dispenser channel 6', as described below. Given that the two blades 31 are both flat and lie in a single plane, the capacity of the core 2' to move relative to the stub 1' is unidirectional. In other words, the core 2' may only move in a plane that is perpendicular to the plane containing the two flat blades 31. With reference to FIG. 8*a*, it is thus not possible for the core 2' to move in the plane of the sheet, but only perpendicularly to the plane of the sheet. The sheathing 4' also comprises a main body 41 that extends around the flexible bridge 3', and that connects the stub 1' to the core 2'. The sheathing 4' also comprises trim 42 that extends around the frustoconical bottom portion of the core 2', as can be seen in FIG. 6. The sealing extension 43 passes through the borehole 24 of the core 2', and is extended so as to form an O-ring gasket 44 that can be seen more clearly in FIG. 9*b*.

The applicator pad 5' is fitted axially on the core 2', such that all of the segments 16, 26, 346, 46, and 56 of the dispenser channel 6' are completely in alignment along the main axis of the head T2. As with the pad 5 of the first embodiment, the pad 5' defines a dispenser orifice 53 and an application surface 52 that presents a shape that is generally convex and sloping. The pad 5' also forms a skirt 57 that extends around the core 2', so as to come into contact with the trim 42. The O-ring gasket 44 is flattened by the pad 5' against the core 2', so as to form sealing continuity between the core 2' and the pad 5'.

In this second embodiment, the flexible bridge 3' does not form a segment of the dispenser channel 6' on its own. The channel segment 346 in the flexible link section S' is formed both by the sheathing 4' and by the two flexible flat blades 31. More precisely, the major portion of the segment 346 is formed by the sheathing 4', the blades 31 coming into contact with the segment 46 only at their opposite inside edges. In the absence of the sheathing 4', the segment 16 would not be connected to the segment 26 of the dispenser channel 6'. Before overmolding the sheathing 4' on the single-piece base E', the core 2' can move with great freedom in a plane determined by the flat blades 31. Thus, the sheathing 4' makes it possible not only to constitute the segment 346 of the dispenser channel 6', but also makes it possible to limit the degree to which the core 2' can move, while maintaining a certain amount of resilience.

Although not shown in the figures, it is also possible to envisage making a flexible bridge between the stub and the core in the form of a single rod or wire that does not even come into contact with the dispenser channel. In this configuration, the flexible bridge serves only as a path for passing material between the stub and the core while molding the base as a single piece. The sheathing that is then overmolded around the flexible bridge makes it possible to reinforce the connection between the core and the stub while enabling some degree of freedom at the core.

Regardless of the embodiment of the invention, the single-piece base comprises a flexible bridge that connects the connection stub to the assembly core, the flexible bridge optionally forming all or part of the segment of the dispenser channel, the sheathing coming to surround the flexible bridge so as to reinforce its elastic resilience and possibly constitute all or part of the segment of the dispenser channel.

Reference is made below to FIGS. 10 and 10*b*, which show the dispenser and applicator head T1 of the first embodiment mounted on a dispenser unit comprising a pump P associated with a fluid reservoir R1. More precisely, the pump P is a laterally-actuated pump that includes a laterally-actuated pusher P4 that, on being depressed, serves to reduce the volume of a pump chamber P1 that is provided at its inlet with an inlet valve P2, and its outlet P5 with an outlet valve P3. The head T1 is mounted in the outlet P5 that advantageously forms a mounting housing for receiving the connection stub 1 in permanent and leaktight manner. The pump P is mounted on a neck R11 of a slide cylinder R10 in which a follower piston R12 moves. This is a non-limiting embodiment for a dispenser unit that is suitable for receiving the dispenser and applicator head of the invention.

In FIGS. 11*a* and 11*b*, the dispenser unit is in the form of a squeezable tube R2 that is provided with a neck R21 in which there is engaged the connection stub 1' of the dispenser and applicator head T2 of the second embodiment of the invention.

Naturally, the head T2 could be mounted on the dispenser unit in FIGS. 10*a* and 10*b*, and vice versa.

The invention thus provides a dispenser and applicator head that is constituted by three elements only, namely a single-piece base, sheathing, and an applicator pad. The ability of the applicator pad 5 to move relative to the connection stub is practically or totally uncorrelated with the rigid flexible material for forming the base. The sheathing 4 that extends around the flexible bridge so as to form the flexible link section makes it possible to protect the flexible bridge and to guarantee a degree of controlled and resilient flexibility.

The invention claimed is:

1. A dispenser and applicator head for associating with a dispenser unit, the head comprising:

a connection stub that is made out of a first material and that is for connecting to the dispenser unit;

an assembly core that is made out of the same material as the connection stub;

a flexible link section that interconnects the connection stub and the assembly core;

a fluid applicator pad for coming into contact with an application surface, so as to apply fluid to the application surface, the applicator pad being made out of a heat-transfer material so as to impart a cold sensation on contact with the skin, the applicator pad being mounted on the assembly core; and a dispenser channel that passes through the connection stub, the flexible link section, the assembly core, and the applicator pad in which the channel forms a dispenser orifice;

the dispenser and applicator head being characterized in that the flexible link section comprises:

a flexible bridge that is made out of the same material as the connection stub and the assembly core, the flexible bridge interconnecting the connection stub and the assembly core in such a manner as to form a single-piece base; and sheathing that is made out of an elastically-deformable second material that is more flexible than the first material, the sheathing surrounding the flexible bridge, at least in part, and interconnecting the connection stub and the assembly core.

2. A head according to claim 1, wherein the sheathing is overmolded on the single-piece base.

3. A head according to claim 1, wherein the flexible bridge presents a wall thickness that is small compared to the connection stub and the assembly core.

4. A head according to claim 1, wherein the dispenser channel, at the link section, is formed by the flexible bridge only.

5. A head according to claim 1, wherein the dispenser channel, at the link section, may be formed both by the flexible bridge and by the sheathing.

6. A head according to claim 1, wherein the dispenser channel, at the link section, is formed by the sheathing only.

7. A head according to claim 1, wherein the applicator pad has a segment of dispenser channel passing therethrough and defining an upstream inlet and a downstream end that is formed by the dispenser orifice, the sheathing including a sealing extension that forms an O-ring gasket that is wedged between the assembly core and the applicator pad, around the upstream inlet, so as to form a sealed connection between the rigid assembly core and the applicator pad at the dispenser channel.

8. A head according to claim 1, wherein the sheathing includes trim that extends around the assembly core as far as the applicator pad, so as to mask the assembly core, at least in part.

9. A head according to claim 1, wherein the flexible bridge presents deformability that is unidirectional.

10. A head according to claim 1, defining a main axis that extends at least through the connection stub, the applicator pad being mechanically fitted and mounted on the assembly core along a mounting axis that extends transversally relative to the main axis.

11. A head according to claim 10, wherein the assembly core includes two mounting slideways and the applicator pad includes two slide rails that are received in the two mounting slideways along the mounting axis that is advantageously perpendicular to the dispensing axis of the dispenser orifice.

12. A fluid dispenser comprising a fluid dispenser unit and a dispenser and applicator head according to claim 1, wherein the dispenser unit comprises a pump or a squeezable tube including an opening on which the connection stub is mounted.

13. The head according to claim 1, wherein the dispenser unit is as a pump, a valve, or a squeezable tube.

14. The head according to claim 1, wherein the first material is rigid.

15. The head according to claim 1, wherein the flexible bridge comprises at least one flat blade that is foldable in a single plane.

16. The head according to claim 1, wherein the fluid applicator pad is configured to come into contact with skin.

17. The head according to claim 16, wherein the dispenser unit is as a pump, a valve, or a squeezable tube.

18. The head according to claim 1, wherein the heat-transfer material of the applicator pad is made out of metal or ceramic.

19. A dispenser and applicator head for associating with a dispenser unit, comprising:

a connection stub that is for connecting to the dispenser unit;

an assembly core;

a fluid applicator pad for coming into contact with an application surface, so as to apply fluid to the application surface, the applicator pad being mounted on the assembly core; and a dispenser channel that passes through the connection stub, the assembly core and the applicator pad and forms a dispenser orifice;

wherein a main axis extends at least through the connection stub and the assembly core, the applicator pad being mechanically fitted and mounted on the assembly core along a mounting axis that extends transversally relative to the main axis, the mounting axis also perpendicular to a dispensing axis for the dispenser orifice.

* * * * *